US005706894A

United States Patent [19]

Hawkins, III

[11] Patent Number: 5,706,894

[45] Date of Patent: Jan. 13, 1998

[54] AUTOMATIC SELF ENERGIZING STOP COLLAR

[75] Inventor: Samuel P. Hawkins, III, Mineral Wells, Tex.

[73] Assignee: Frank's International, Inc., Houston, Tex.

[21] Appl. No.: 670,779

[22] Filed: Jun. 20, 1996

[51] Int. Cl.[6] ..... E21B 23/00

[52] U.S. Cl. ..... 166/208; 166/217

[58] Field of Search ..... 166/88.2, 98, 117.7, 166/208, 210, 216, 217

[56] References Cited

U.S. PATENT DOCUMENTS 3,614,139 10/1971 Harrison ..... 166/241.6 X
4,711,326 12/1987 Baugh et al. ..... 166/212 X
4,738,565 4/1988 Streatfield et al. ..... 166/55.2 X
4,936,382 6/1990 Thomas ..... 166/88.2
5,501,281 3/1996 White et al. ..... 166/387

*Primary Examiner*—Frank Tsay
*Attorney, Agent, or Firm*—Matthews, Joseph & Shaddox, L.L.P.; Dwayne L. Mason

[57] ABSTRACT

An apparatus for engagement of cylindrical members about the outside diameter, so that downhole tools may be positioned longitudinally along said cylindrical member. A generally cylindrical outer ring is detachably engaged with a generally cylindrical inner ring. Once the inner ring is detached from the outer ring it is automatically present into position by a spring clamping force exerted between the pipe and inner ring. Relative axial motion of the outer ring with respect to the inner ring automatically energizes the inner ring inward providing the high clamping force required to set the self energizing stop collar in its final position.

10 Claims, 2 Drawing Sheets

FIG. 1
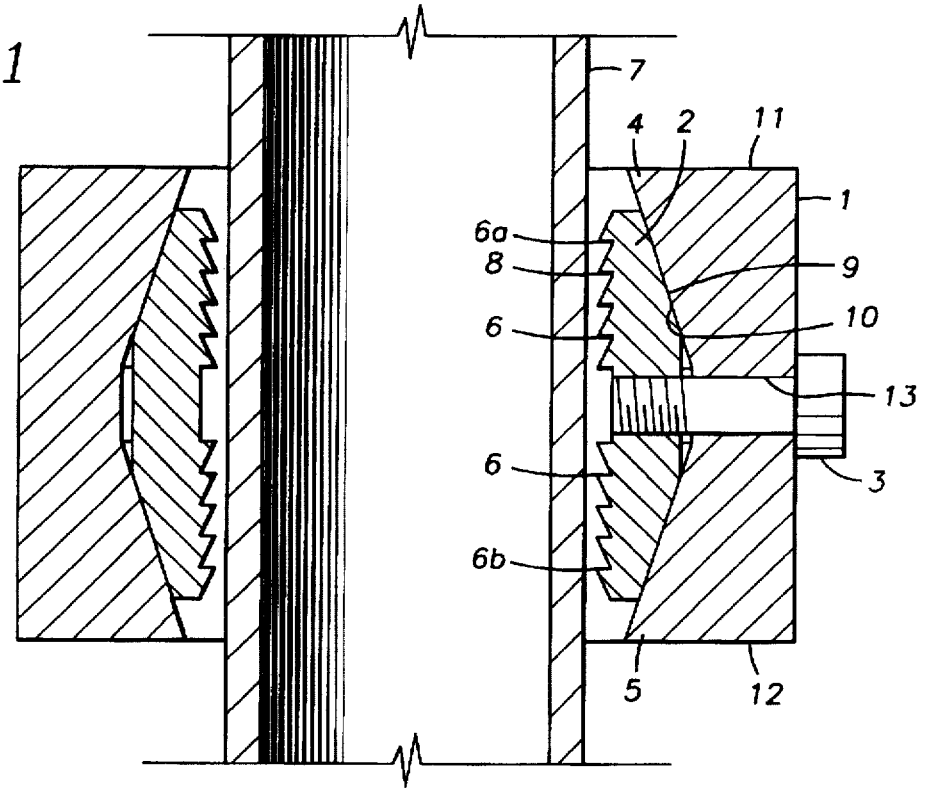
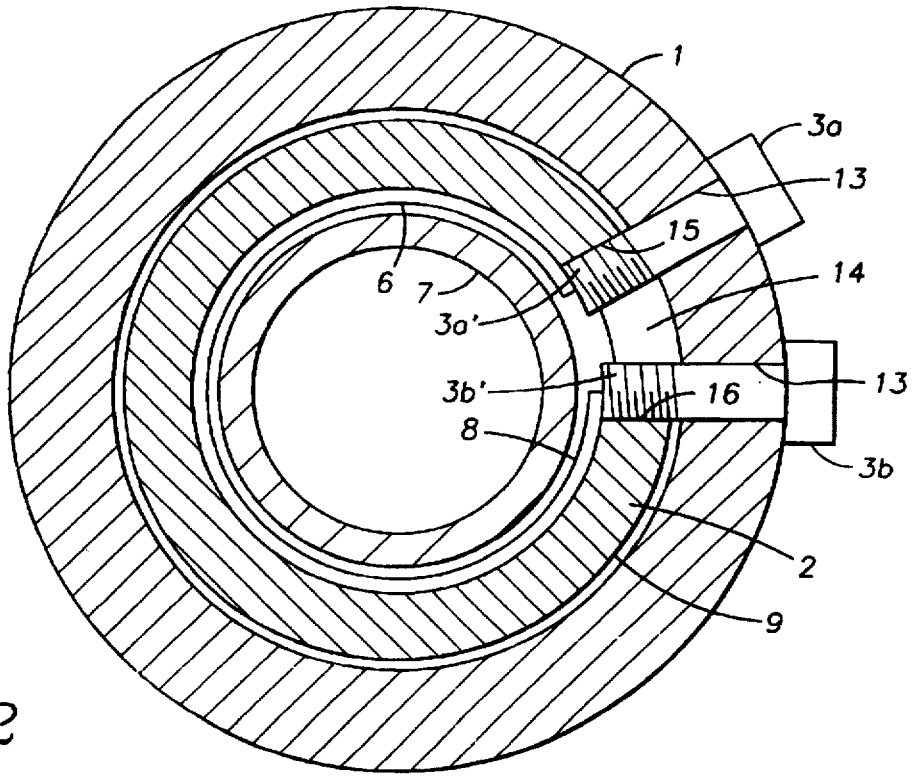
FIG. 2

FIG. 3
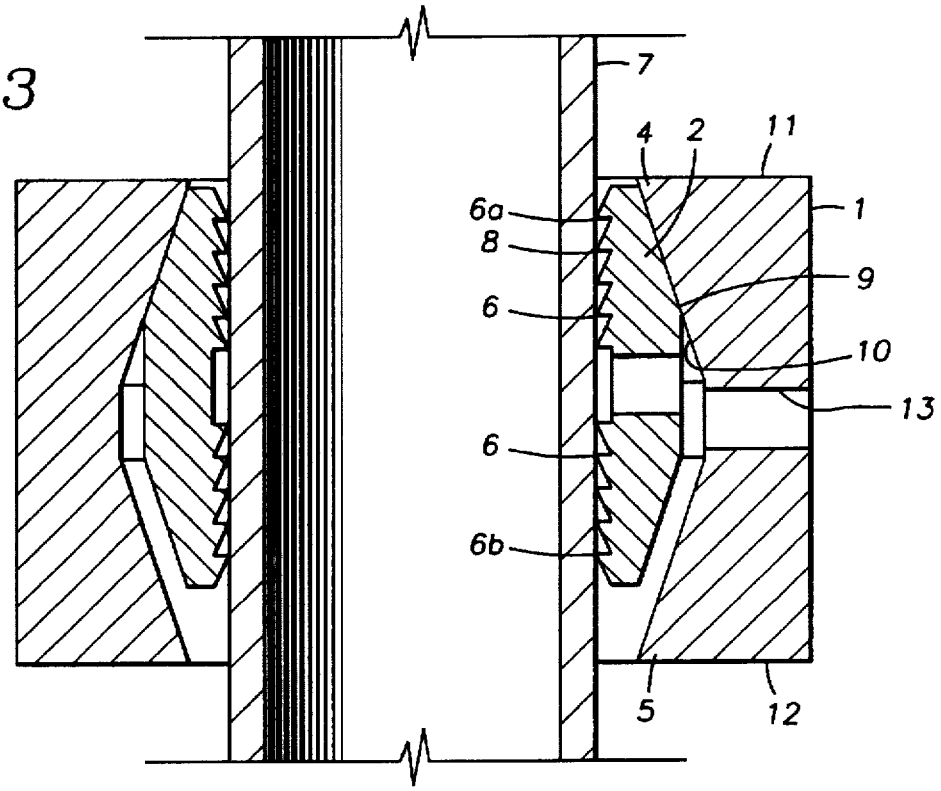
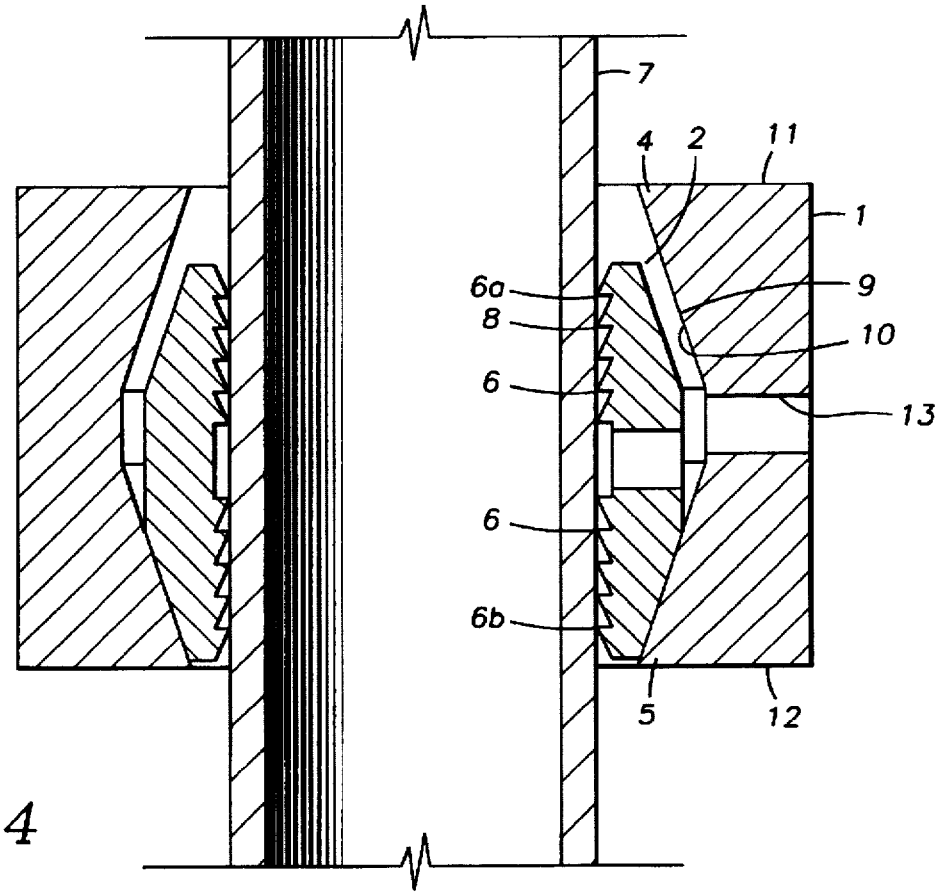
FIG. 4

AUTOMATIC SELF ENERGIZING STOP COLLAR

BACKGROUND

The invention relates to devices for gripping tubular members, such as drill pipe or production tubing, and for suspending objects thereon. More particularly, the invention relates to self energizing type devices, which automatically engage with the pipe or cylindrical member. In the field of well drilling and production there are requirements for suspending various downhole tools on and in the casing and wellbore for repairing and maintenance purposes. Devices commonly known as stop collars have been developed to aid in positioning the various downhole tools about the casing and wellbore.

Well drilling is a very time consuming and therefore expensive operation. Rental costs for equipment as well as manpower requirements make it imperative that each and every operation be completed as efficiently as possible. Downhole tools must be positioned in a precise manner within the wellbore as quickly as possible. The time required to position the tool is highly dependent on the stop collar installation. Stop collar installation efficiency is highly dependent on the means employed to fix the collar in place longitudinally along the well casing.

The traditional means employed to fix the stop collar longitudinally along the casing include the use of welding, setscrews, wedge pins, knockdown buckles, wedging strips, and slips with inner wickers or teeth. Devices utilizing these means have traditionally required significant manual intervention and manhours to fix the stop collar in place. For example, each buckle of the knockdown buckle design must be hammered down against the casing for proper engagement. With the exception of welding which is cost and time prohibitive, the traditional means of fixing the stop collar in place are subject to disengagement from vibration or other similar forces. Further, the manual intervention subjects the traditional devices to misalignment due to installation errors, which may cause the stop collar to disengage from the casing. Thus, the installation of the more traditional devices require significant manual intervention, which increases costs, and increases the potential for stop collar failure as well as tool and wellbore damage.

Therefore, there remains a need for a stop collar that allows for the precise positioning of downhole tools, that may be installed quickly, and is not subject to disengagement from vibration or other similar forces.

For the foregoing reasons, there is a need for a self energizing stop collar which may be easily and automatically fixed into position along a cylindrical member.

For the foregoing reasons there is a need for a stop collar assembly with a minimal number of component pieces. The limited number of component pieces increases the ease with which the device may be installed, and decreases the probability of a failure or errors in the installation process.

For the foregoing reasons, there is a need for a stop collar which may be easily slipped over the top of the cylindrical member, and fixed into position without the additional requirement of manually energizing multiple gripping mechanisms.

For the foregoing reasons, there is a need for a stop collar, which reduces the potential for misalignment, and which can hold against an upward or downward force without movement.

SUMMARY

The present invention is directed to a device that satisfies the aforementioned needs. A self energizing stop collar having features of the present invention includes an outer ring, inner ring, and activating means. The outer ring is rigid and generally cylindrical, with a central axial bore larger than the outside diameter of the cylindrical member. The outer ring further includes an annular cavity extending radially outward from the central bore, which is of sufficient depth to accommodate the inner ring. The inner ring is rigid and generally cylindrical, with a slightly smaller inside diameter than the outside diameter of the cylindrical member. The inner ring is positioned between the outer ring and the cylindrical member to be engaged. The inner ring has an outer face, which is capable of conformable engagement with the central cavity of the outer ring, and has an inner face which is adapted with means for gripping engagement with the cylindrical member. The self energizing stop collar further includes means for securing the inner ring to the outer ring so as to allow the stop collar to be moved longitudinally along the cylindrical member as well as to initiate the self energizing automatic engagement with the tubular member.

BRIEF DESCRIPTION OF THE DRAWINGS

FIG. 1 is a schematical isometric partial sectional view of the self energizing stop collar.

FIG. 2 is schematical cross-sectional view of the self energizing stop collar.

FIG. 3 discloses the present invention in operation with upward force on the tubular.

FIG. 4 discloses the present invention in operation with downward force on the tubular.

DESCRIPTION

The preferred embodiment of the present invention has three major components, those being a rigid, generally cylindrical outer ring; a rigid, generally cylindrical inner ring in detachable engagement with the outer ring, and adapted with gripping means on the inner surface; and, further includes further includes means for securing or disengaging the inner ring to and from the outer ring. The preferred embodiment is capable of holding against forces of 60,000 pounds from either above or below the assembly. With reference to FIGS. 1 and 2, the first major component of the self energizing stop collar is a rigid generally cylindrical outer ring, 1. The outer ring, 1, is generally cylindrical with a central axial bore larger than the outside diameter of the cylindrical member, 7. A generally located annular cavity, 10, extends radially outward from the central bore, which is of sufficient depth and shape to accommodate and allow for conformable engagement with the inner ring, 2. The outer ring, 1, also includes retaining means located on the upper end, 11, and lower end, 12, of the outer ring, 1. The retaining means serves two purposes. First, the retaining means serves the purpose of retaining the inner ring, 2, between the outer ring, 1, and the cylindrical member, 7. Second, the retaining means functions in concert with the outer ring, 1, to further energize the inner ring inward and onto the cylindrical member, 7, via axial motion of the outer ring with respect to the inner ring, 2. In the preferred embodiment the retaining means comprises an upper loadface, 4, and lower loadface, 5, which extends radially inward from the annular cavity, 10, of the outer ring, 1, and toward the cylindrical member, 7. The upper loadface, 4, and lower loadface, 5, extend toward the cylindrical member, 7, a distance sufficient to prevent any portion of the inner ring, 2, from extending beyond the upper end, 11, or lower end, 12, of the outer ring, 1. However, an alternative embodiment may include only a single loadface located on one end of the outer ring, 1, which would result in a device capable of holding a load in a single direction only. Such a configuration would have to be place over the cylindrical member, 7, with the correct orientation for the service it is intended to perform, e.g., to hold against an upward force only, or to hold against a downward force only. Further, in the preferred embodiment, the outer ring, 1, includes a plurality of centrally located outer ring apertures, 13, which extend longitudinally through the outer ring, 1.

With further reference to FIGS. 1 and 2, the second major component of the self energizing stop collar is the inner ring, 2. The inner ring, 2, is a rigid, generally cylindrical ring. The inner ring, 2, is positioned between the outer ring, 1, and the cylindrical member, 7, to be engaged. The inside diameter of the inner ring, 2, is slightly smaller than the outside diameter of the cylindrical member, 7. The inner ring, 2, includes an inner face, 8, and an outer face, 9. The outer face, 9, is of suitable shape such that it may be conformably engaged with the central cavity, 10, of the outer ring, 1. In the preferred embodiment, the inner ring, 2, is open ended, however it is obvious to one skilled in the art that the ring could be a complete unopen cylindrical ring. The inner ring, 2, includes an open slot area, 14, defined by opposing faces of the inner rings, 14, and, 15. During the assembly process, the radius of the inner ring, 2, is expanded, when placed in the present apparatus, by extending the distance between the opposing inner faces, 15 and, 16, and maintaining the open slot area, 15, distance by resting the inner face, 15, against screw, 3*a*, and inner face, 16, against screw, 3*b*. Thus, the inner ring, 2, is held in conformable engagement against the central cavity, 10, of the outer ring, 1, by the activating means, 3. Thus, in the uninstalled state, the inner ring, 2, is fixed to the outer ring, 1, in an elastic expanded state so as to allow the self energizing stop collar assembly to be positioned longitudinally along the cylindrical member, 7, to a desired position. The inner face, 8, is adapted with gripping means, 6, for engagement with the outside diameter of the cylindrical member, 7. In the preferred embodiment, the gripping means is a slip, 6, having wickers or teeth thereon. The slip, 6, includes an upper portion, 6*a*, and a lower portion, 6*b*. The wickers or teeth on the upper portion, 6*a*, of the slip, 6, are tapered in a downward and inward direction, which provides the primary engagement with the cylindrical member, 7, when the device receives a load or force from above. The wickers or teeth on the lower portion, 6*b*, of the slip, 6, are tapered in an upward and inward direction, which provides the primary engagement with the cylindrical member, 7, when the device receives a load or force from below. In an alternative embodiment the slip wickers or teeth may be tapered in the direction opposite the load or force and inward for holding against a load in a single direction only.

Further, referring to FIGS. 1 and 2, the last major component of the self energizing stop collar is the activating means, 3. The activating means, 3, has two functions. The first function is to secure the inner ring, 2, within the central cavity of the outer ring, 1, in its elastic expanded state so as to allow the self energizing stop collar to be traversed longitudinally along the cylindrical member, 7, to a desired location. The second function of the activating means, 3, is to initiate the self energizing function of the device. The present invention incorporates a self-energizing function such that the inner ring, 2, is predisposed to clamp inwardly and tightly around a tubular, 7. The self energizing function is initiated by the release of the inner ring, 2, from the outer ring, 1, by removing screws, 3*a* and 3*b*, once the stop collar is at the desired position on the cylindrical member, 7. Once the inner ring, 2, is released from the outer ring, 1, the opposing faces, 15 and 16, of the inner ring, 2, are drawn inward which causes the inner ring, 2, to snap into contact with the cylindrical member, 7, exerting a spring clamping force therebetween, which presets the self energizing stop collar in position. Axial motion from load forces exerted by downhole tools, either from above or below, on the outer ring, 1, automatically energizes the inner ring, 2, and therefore the slip, 6, inward, which initiates the high clamping forces required to position the self energizing stop collar, and therefore the downhole tool, in a final fixed position. In the preferred embodiment, the activating means, 3, comprises a plurality of removable screws or pins which extend radially inward through the centrally located apertures formed in the outer ring, 1. The screws or pins, 3*a* and 3*b*, are positioned radially such that either end of the inner ring, 2, may be forced a distance apart such that each opposing face, 15 and 16, of the inner ring, 2, may rest against the posts, $3a^1$ and $3b^1$, of the screws, 3*a* and 3*b*. In this position the inner ring, 2, releasably engaged with the annular cavity, 10, of the outer ring, 1, and is in its fully expanded state.

To install the preferred embodiment of the self energizing stop collar assembly, the device is simply slipped over the top of the cylindrical member, 7, which passes through the bore of the assembly. The stop collar is then allowed to descend (or ascend) to the desired position. Once the self energizing stop collar is at the desired position, the activating means, 3, is initiated. When the activating means, 3, is initiated, the inner ring, 2, snaps inward at a point within the outer ring, 1, whereby the inner ring, 2, comes into engaging contact with the cylindrical member, 7. The self energizing stop collar is now preset into position about the cylindrical member, 7. After the self energizing stop collar is preset into position, any contact of the stop collar with a load or force from a downhole tool, from above or below, further energizes the inner ring, 2, inward and provides the high clamping force required to fix the stop collar and the downhole tool in its final position on the cylindrical member.

Those who are skilled in the art will readily perceive how to modify the present invention still further. As many possible embodiments may be made of the present invention without departing from the scope thereof, it is to be understood that all matter herein set forth or shown in the accompanying drawings is to be interpreted as illustrative and not in a limiting sense.

Accordingly, the foregoing description should also be regarded as only illustrative of the invention, whose full scope is measured by the following claims.

What is claimed is:

1. A self energizing stop collar assembly, for engagement with the outside diameter of a cylindrical member comprising:

a. a rigid, generally cylindrical outer ring having an axial bore larger than said cylindrical member to be engaged, and having a somewhat larger central cavity therein;

b. a rigid, generally cylindrical open-ended inner ring, positioned between the outer ring and the cylindrical member to be engaged, having an inner face and an outer face; said outer face capable of conformable engagement with the central cavity of said outer ring; and said inner face adapted with gripping means for engagement with said cylindrical member; and c. activating means for securing said inner ring to said outer ring in releasable attachment thereto, so as to allow the stop collar to be moved longitudinally along said cylindrical member, and to initiate the engagement of said inner ring to said cylindrical member.

2. The self energizing stop collar assembly of claim 1, wherein said outer ring includes retaining means on either end of said outer ring to confine said inner ring within said outer ring and cylindrical member.

3. The self energizing stop collar assembly of claim 2, wherein said retaining means comprises an upper loadface and a lower loadface.

4. The self energizing stop collar assembly of claim 3, wherein said outer ring includes a plurality of threaded apertures extending radially inward therethrough, wherein said activating means comprises removable screws which extend radially inward through said threaded apertures, and wherein each end of said inner ring engages with the post of each screw.

5. The automatic self energizing stop collar of claim 4, wherein said gripping means comprises a slip with teeth, wherein said slip includes an upper portion and a lower portion, wherein said teeth on said upper portion are tapered downward and inward, and wherein said teeth on said lower portion are tapered upward and inward.

6. A self energizing stop collar assembly, for engagement with the outside diameter of a cylindrical member comprising:

a. a rigid, generally cylindrical, outer ring having an axial bore larger than said cylindrical member to be engaged, and having a somewhat larger central cavity therein; said outer ring having retaining means located on one end of said outer ring;

b. a rigid, generally cylindrical, open ended inner ring, positioned between the outer ring and the cylindrical member to be engaged, having an inner face and an outer face; said outer face is capable of conformable engagement with the central cavity of said outer ring; said inner face is adapted with gripping means for engagement with said cylindrical member; and c. activating means for securing said inner ring to said outer ring in releasable attachment, so as to allow the stop collar to be moved longitudinally along said cylindrical member, and to allow the automatic self energizing engagement of said stop collar with said cylindrical member.

7. The self energizing stop collar of claim 6, wherein said retaining means comprises a load face.

8. The self energizing stop collar assembly of claim 7, wherein said retaining means comprises a lower loadface.

9. The self energizing stop collar assembly of claim 8, wherein said outer ring includes a plurality of threaded apertures extending radially inward therethrough, wherein said activating means comprises removable screws which extend radially inward through said threaded apertures, and wherein each end of said inner ring engages with the post of each screw.

10. The automatic self energizing stop collar of claim 9, wherein said gripping means comprises a slip with teeth, wherein said teeth are tapered on the direction opposite of said load face and inward.

* * * * *